US009220966B2

(12) United States Patent
Garner et al.

(10) Patent No.: US 9,220,966 B2
(45) Date of Patent: Dec. 29, 2015

(54) WATERSPORT RESISTANCE TRAINING DEVICE

(71) Applicants: David Kent Garner, Johnson City, TN (US); Terri Lynn Garner, Johnson City, TN (US)

(72) Inventors: David Kent Garner, Johnson City, TN (US); Terri Lynn Garner, Johnson City, TN (US)

( * ) Notice: Subject to any disclaimer, the term of this patent is extended or adjusted under 35 U.S.C. 154(b) by 141 days.

(21) Appl. No.: 14/199,639

(22) Filed: Mar. 6, 2014

(65) Prior Publication Data

US 2014/0256514 A1 Sep. 11, 2014

Related U.S. Application Data

(60) Provisional application No. 61/776,706, filed on Mar. 11, 2013.

(51) Int. Cl.

| | |
|---|---|
| ***A63B 21/002*** | (2006.01) |
| ***A63B 21/02*** | (2006.01) |
| ***A63B 21/04*** | (2006.01) |
| ***A63B 69/18*** | (2006.01) |
| ***A63B 21/055*** | (2006.01) |
| ***A63B 21/068*** | (2006.01) |
| ***A63B 21/00*** | (2006.01) |
| ***A63B 21/16*** | (2006.01) |
| *A63B 71/00* | (2006.01) |

(52) U.S. Cl.

CPC ..... *A63B 69/187* (2013.01); *A63B 21/00061* (2013.01); *A63B 21/0442* (2013.01); *A63B 21/055* (2013.01); *A63B 21/068* (2013.01); *A63B 21/1469* (2013.01); *A63B 21/1663* (2013.01); *A63B 2071/0072* (2013.01)

(58) Field of Classification Search

CPC ..... A63B 21/00061; A63B 21/002; A63B 21/0023; A63B 21/02; A63B 21/04; A63B 21/068; A63B 21/0442; A63B 21/055; A63B 21/1469; A63B 21/1663; A63B 2021/0026; A63B 2071/0072; A63B 69/187

USPC ..... 482/91, 121–130

See application file for complete search history.

(56) References Cited

U.S. PATENT DOCUMENTS

| | | | | |
|---|---|---|---|---|
| 4,060,049 | A | 11/1977 | Rumbaugh | |
| 4,195,835 | A | 4/1980 | Hinds et al. | |
| 4,974,836 | A | 12/1990 | Hirsch | |
| 5,040,788 | A * | 8/1991 | Randall | A63B 21/0552 473/229 |
| 5,209,712 | A * | 5/1993 | Ferri | A61H 1/02 482/131 |
| 5,318,488 | A | 6/1994 | Babcock | |
| 5,342,266 | A | 8/1994 | Dailey | |
| 5,571,064 | A | 11/1996 | Holm | |
| 6,322,483 | B1 * | 11/2001 | Rotella | A63B 21/0552 482/121 |
| 8,083,653 | B2 | 12/2011 | Hetrick | |
| 8,944,976 | B2 * | 2/2015 | Crowell | A63B 21/0442 482/121 |

*Primary Examiner* — Loan H Thanh
*Assistant Examiner* — Joshua Lee
(74) *Attorney, Agent, or Firm* — Jason T. Daniel, Esq.; Daniel Law Offices, P.A.

(57) ABSTRACT

A watersport resistance training device includes an elongated inelastic strap having an anchor an anchor unit disposed along a first end, and a ski handle assembly disposed along a second end. A plurality of rings is disposed along the middle section of the inelastic strap, and one or more watersport resistance elements are removably connected to at least two of the rings.

20 Claims, 9 Drawing Sheets

(56) References Cited

U.S. PATENT DOCUMENTS

2004/0215114 A1* 10/2004 Cruz ..... A61H 11/00 601/132
2007/0173383 A1* 7/2007 Feigenbaum ..... A63B 21/1663 482/91
2009/0075788 A1* 3/2009 Hetrick ..... A63B 21/0023 482/91
2010/0317495 A1* 12/2010 DiGiovanni ..... A63B 21/0552 482/129
2012/0270706 A1* 10/2012 Wu ..... A63B 7/02 482/91
2012/0295776 A1* 11/2012 Chen ..... A63B 21/0442 482/121
2013/0157821 A1* 6/2013 Crowell ..... A63B 21/0442 482/129
2013/0165301 A1* 6/2013 Thrasher-Rudd ..... A63B 21/04 482/129
2013/0190148 A1* 7/2013 Allison ..... A63B 21/0442 482/129
2013/0196831 A1* 8/2013 Kinsbourne ..... A63B 21/0442 482/129

* cited by examiner

WATERSPORT RESISTANCE TRAINING DEVICE

CROSS-REFERENCE TO RELATED APPLICATIONS

This application claims the benefit of U.S. Application Ser. No. 61/776,706 filed on 11 Mar. 2013, the contents of which are incorporated herein by reference.

TECHNICAL FIELD

The present invention relates generally to resistance strength training devices and more particularly to a resistance training device for watersport enthusiasts that simulates the pulling force of a boat.

BACKGROUND

The statements in this section merely provide background information related to the present disclosure and may not constitute prior art.

Watersport enthusiasts face a unique challenge when practicing their craft. Unlike other sports, skiers are constantly subjected to the pulling force of the boat from which they are being towed. Depending on the particular watersport activity (e.g., waterskiing, slalom, and/or wakeboarding) and the composition of the water surface, this force can vary greatly. In addition to the above, any movements performed by the skier (e.g., jumps, turns, twists, bends and the like) must be balanced against the pulling force of the ski rope.

For this reason, many skiers regularly perform calisthenics and/or resistance training in an attempt to keep their bodies in peak physical shape. In this regard, conventional resistance exercise devices allow a user to exercise by providing a resistance to the movement of a user's arms, legs, and/or torso. These devices typically operate by working one of the user's muscles against another, or by working against the weight of the user, by providing a resistance to the movement of a user's arms, legs, or torso. Unfortunately, these elastic resistance devices typically provide resistance that is inconsistent and which increases with increasing displacement, and decrease with decreasing displacement.

Accordingly, it would be beneficial to provide a lightweight portable device which can simulate the pulling force of a boat while simultaneously providing a complete resistance training workout to a user, in a manner that does not suffer from the drawbacks of the above noted devices.

SUMMARY OF THE INVENTION

The present invention is directed to a watersport resistance training device. One embodiment of the present invention can include an elongated inelastic strap having a plurality of rings for engaging one or more elastic watersport resistance elements. The strap including an anchor unit along a first end for securing the device to a structure, and a ski handle assembly at an opposite end for engaging a user.

The resistance elements can function to engage the inelastic strap via the rings to create a plurality of user defined watersport resistances that mimic the force experienced by a skier in the water in various water conditions and during various watersport activities.

Another embodiment of the present invention can include the ability to utilize any number of different ski handle assemblies and to perform various exercises while simultaneously receiving a constant watersport resistance.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
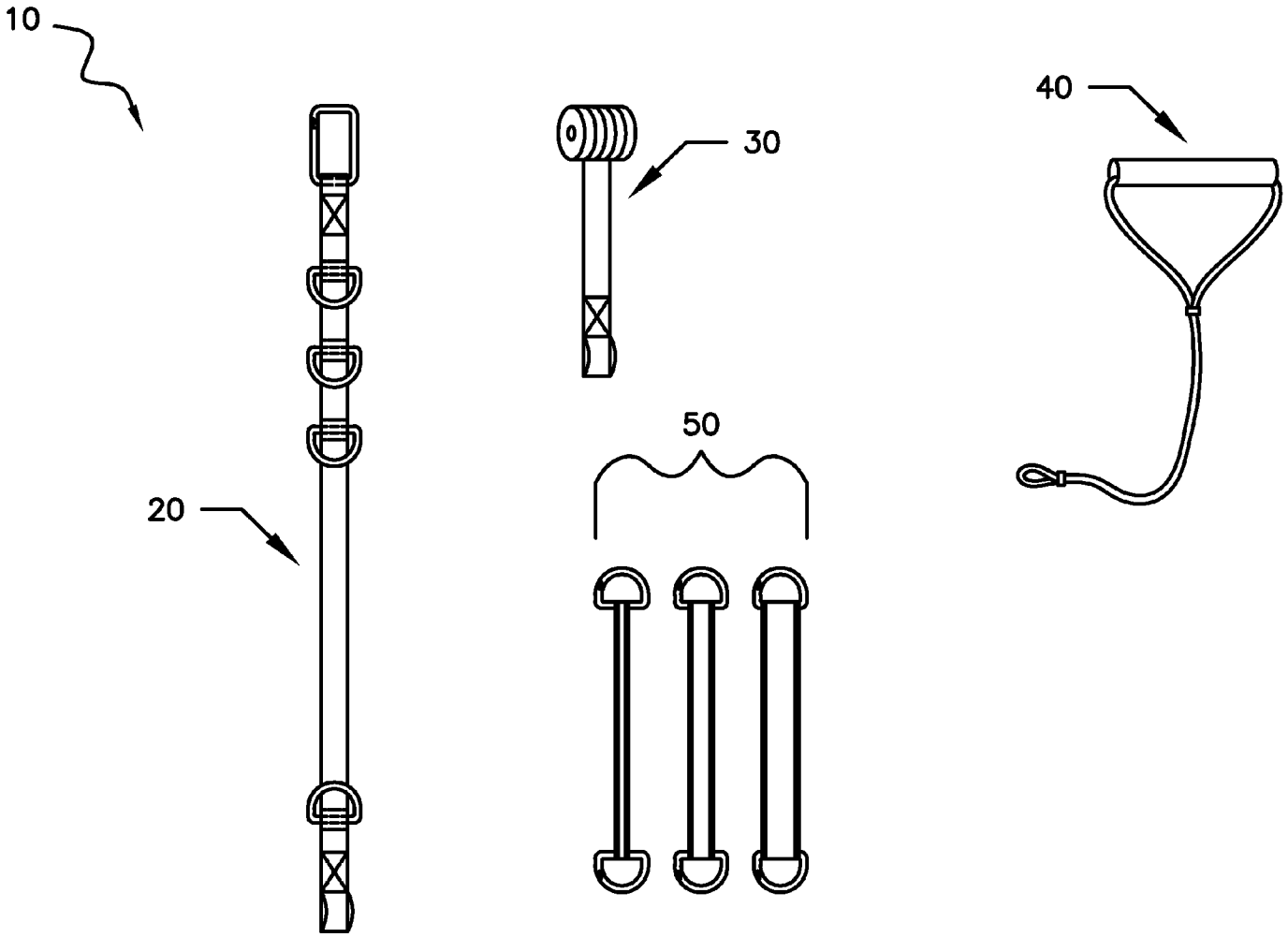
FIG. 1 is an exploded parts view of one embodiment of a watersport resistance training device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the term "watersport resistance" shall be used to describe the actual and constant resistance/pulling force a skier experiences when being towed by a boat during a particular watersport activity. Additionally, the term "removably secured" shall be used to describe a situation wherein two or more objects are joined together in a nonpermanent manner so as to allow the same objects to be repeatedly joined and separated.

In general, the watersport resistance training device provides a combination elastic and inelastic exercise system and method that is highly versatile, portable and can be easily attached to a supporting structure. The device functioning to allow a user to perform a large number of strength training exercises while simultaneously experiencing a watersport resistance. In this regard, the device functions to engage user muscles in a manner identical to what the user will experience during a particular watersport activity. Moreover, by utilizing an actual ski handle and a watersport resistance that is calculated to mimic a particular watersport activity (e.g., waterskiing, or wakeboarding), the device user can practice ski moves such as jumps, twists and the like on dry land, while simulating the forces they will experience on the water.

Through extensive research and experimentation, the inventors have calculated the average watersport resistance experienced by a user holding onto a ski handle during a plurality of common watersport activities and based on typical water conditions. The results are presented in TABLE 1, and the measurements are calculated in pounds.

TABLE 1

| Watersport | Pulling force in pounds (lbs) | |
|---|---|---|
| Activity | calm surface | choppy surface |
| kneeboarding | 15 | 30 |
| trick skiing | 35 | 40 |
| combo skiing/ wakeboarding | 45 | 55 |
| slalom skiing | 60 | 75 |
| air chair | 85 | 90 |

Although described above with respect to specific watersport activities, the inventive concepts disclosed herein are not so limiting. In this regard, those of skill in the art will recognize that any number of different watersport activities can be simulated by the presently claimed invention without undue experimentation. Several other sports including barefoot skiing, kiteboarding, wakeskating and wakesurfing, among many others, for example.

FIG. 1 illustrates an exploded parts view of one embodiment of a watersport resistance training device 10 that is useful for understanding the inventive concepts disclosed herein. As shown, the device 10 can include an inelastic member 20, an anchor unit 30, a ski handle assembly 40 and one or more watersport resistance elements 50.

Figure 2:
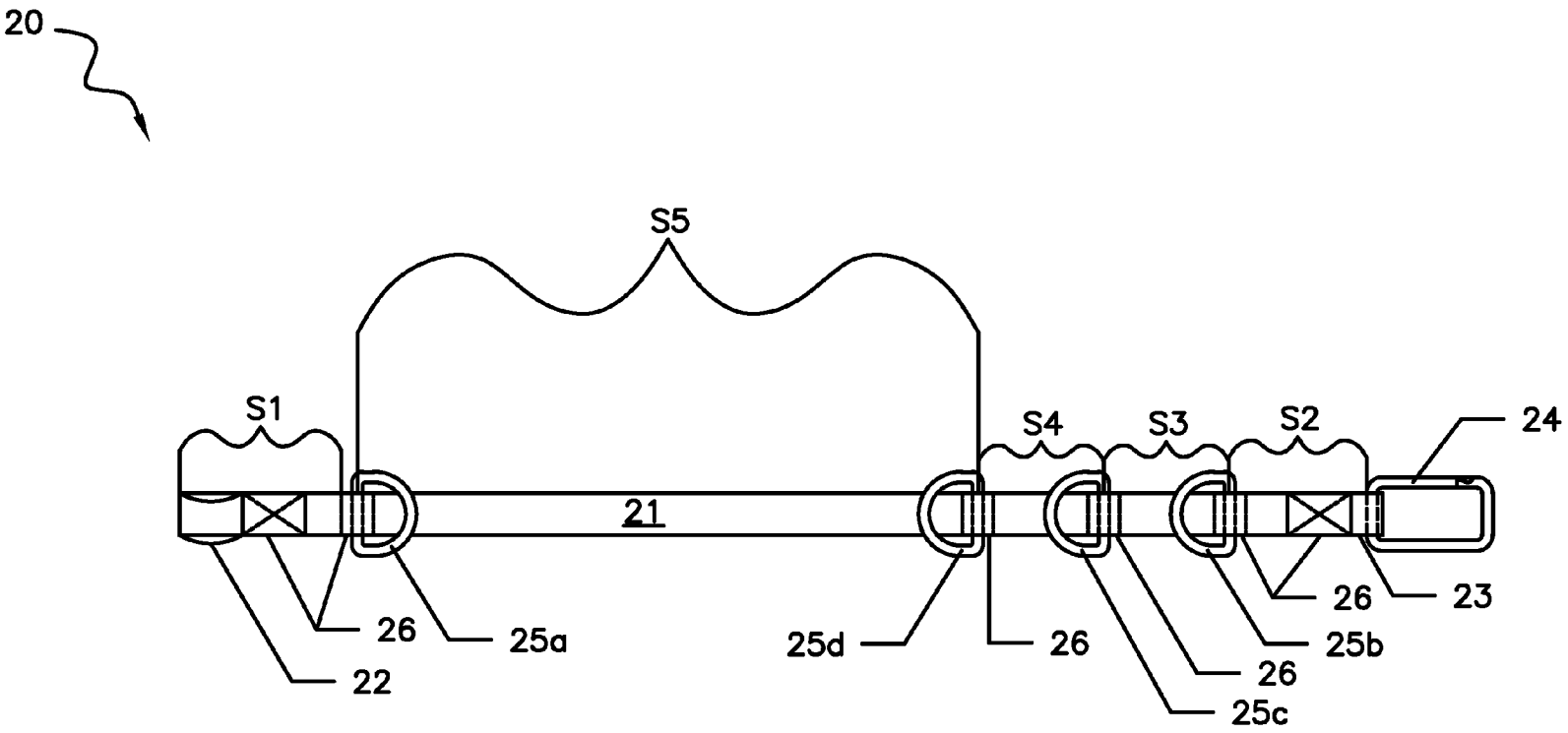
FIG. 2 is a front view of the inelastic member of the watersport resistance training device in accordance with one embodiment of the invention.

As shown in FIG. 2, the inelastic member 20 can include an elongated strap 21 having a first loop 22 along a bottom end, a second loop 23 along a top end, and a removable hook 24 disposed within the second loop. In the preferred embodiment, the hook 24 can include a carabiner, D-ring or other such clasp which can transition between an open and closed state in order to physically secure two or more items together. The elongated strap 21 can be constructed from one or more strips of flexible inelastic material, such as nylon webbing, for example, that is sufficient to maintain a substantially fixed length when pulled by a user. In one exemplary embodiment, the strap 21 can include a length (e.g., measured from the first loop 22 to the second loop 23) of approximately 47 inches, and a width of approximately 1.5 inches. However, other lengths and widths are also contemplated.

The strap 21 can also include a primary ring 25*a* disposed adjacent to the bottom end, and a plurality of other rings 25*b*, 25*c* and 25*d* spaced along the length of the strap. Each of these rings can be secured to the strap 21 via conventional stitching 26, in order to permanently affix the rings onto the strap at a precise location. As will be described below, the location of the individual rings, when utilizing a watersport resistance band will function to provide an accurate representation of watersport resistance during a particular watersport activity. In one embodiment, the first and second rings 25*a* and 25*b* can include a linear spacing as demonstrated by s1 and s2 of approximately 4 inches from the first and second loops 22 and 23, respectively. Moreover, the third ring 25*c* can include a spacing s3 of approximately 6 inches from the second ring 25*b*, and the fourth ring 25*d* can include a spacing s4 of approximately 6 inches from the third ring 25*c*. Finally, rings 25*a* and 25*d* can include a linear spacing s5 of approximately 27 inches.

Although described above as including four rings disposed at specified locations along the strap 21, other embodiments are also contemplated having fewer or greater number of loops and/or different spacing. Accordingly, the member 20 is not to be construed as limiting to the embodiment illustrated.

Figure 3:
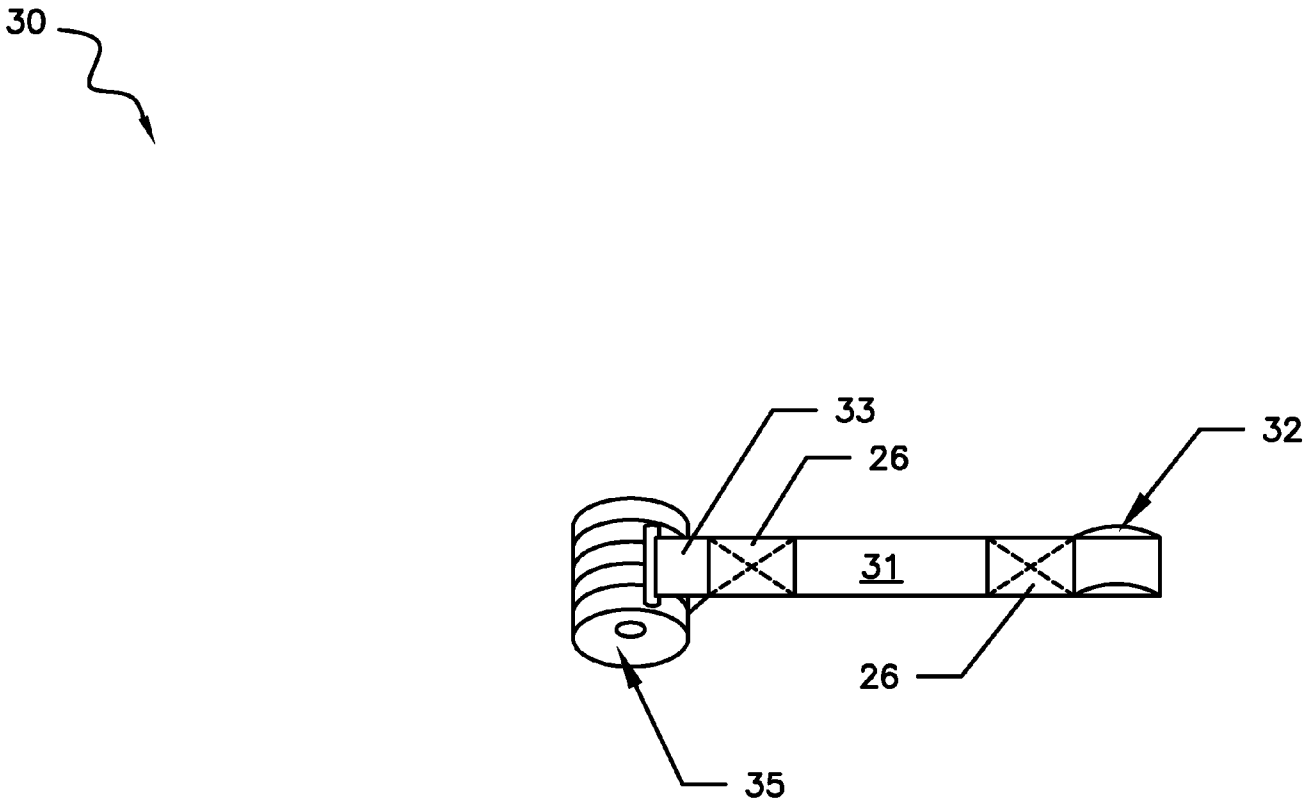
FIG. 3 is a perspective view of the anchor unit of the watersport resistance training device in accordance with one embodiment of the invention.

FIG. 3 illustrates one embodiment of the anchor unit 30 of the device 10. As will be described below, the anchor unit can function to secure the device 10 onto a structure in order to allow operation of the device. In the present embodiment, the anchor unit 30 is functionally constructed for engaging a door and providing support to the remainder of the device components. As such, the anchor unit 30 can include a shortened inelastic strap 31 that can also be constructed from one or more strips of flexible nylon webbing, and having a first loop 32 at one end, and a second loop 33 at the other end. Each of the loops preferably being formed by stitching 26, as described above.

As shown, a connector 35 in the form of an enlarged soft ring can be disposed within the second loop 33 and can function to be placed between a door 2 and a door jamb 3 (See FIG. 6), when the door is in a closed position. In one embodiment, the ring 35 can be constructed from a soft yet sturdy material such as high density foam, for example which will prevent damaging the door when the device is in use. Of course, any number of other types and shapes of connectors can be utilized to secure the anchor strap of the device to a solid structure in order to allow the device to perform as hereinafter described. Several nonlimiting examples of suitable connectors including chains, straps, compression fittings, and conventional anchors nuts and bolts, for example.

Figure 4:
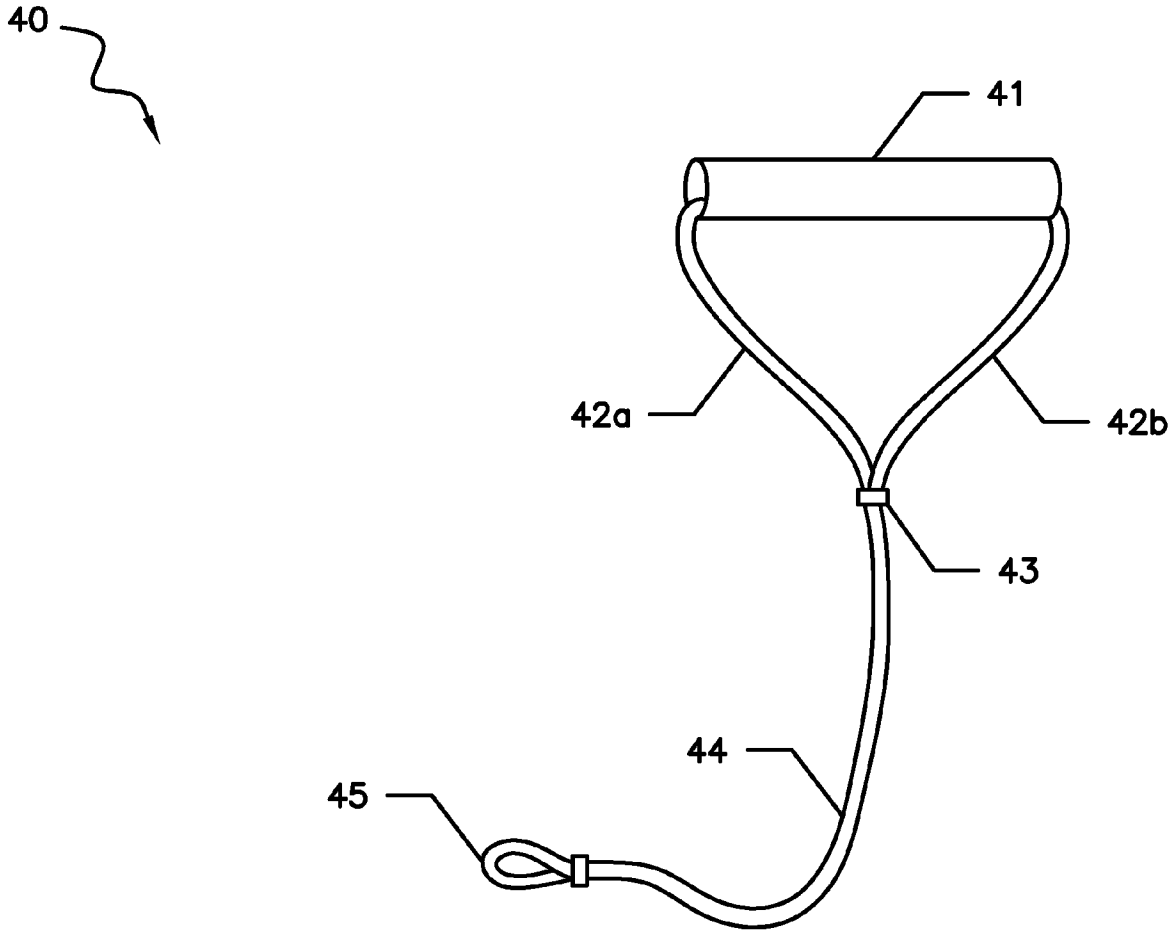
FIG. 4 is a perspective view of the ski handle assembly of the watersport resistance training device in accordance with one embodiment of the invention.

FIG. 4 illustrates one embodiment of a ski handle assembly 40 for use with the device. As shown, the assembly can include a handle portion 41 that is interposed between a pair of angled arms 42*a* and 42*b* which are secured 43 to a rope/tether 44 having a looped portion 45 at a distal end. As will be shown below, the looped portion 45 can preferably be attached directly to the first loop 22 of the inelastic member 20; however, other means for removably securing these elements together such as an additional hook (not illustrated) can also be employed. Alternatively, the rope 44 can be permanently secured to the bottom end of the inelastic member 20 via known methods such as stitching, adhesives and the like.

The construction and usage of ski handles are extremely well known in the art, and include U.S. Pat. No. 4,060,049, for example, the contents of which are incorporated herein by reference. Of course, any number of other types of detachable waterski handles can be utilized herein, such as one handed ski handles and ski handles having various other shapes and sizes. In this regard, the device is not limited to the use of any particular ski handle, as device users may choose to removably secure their own ski handle to the device during operation.

Figure 5:
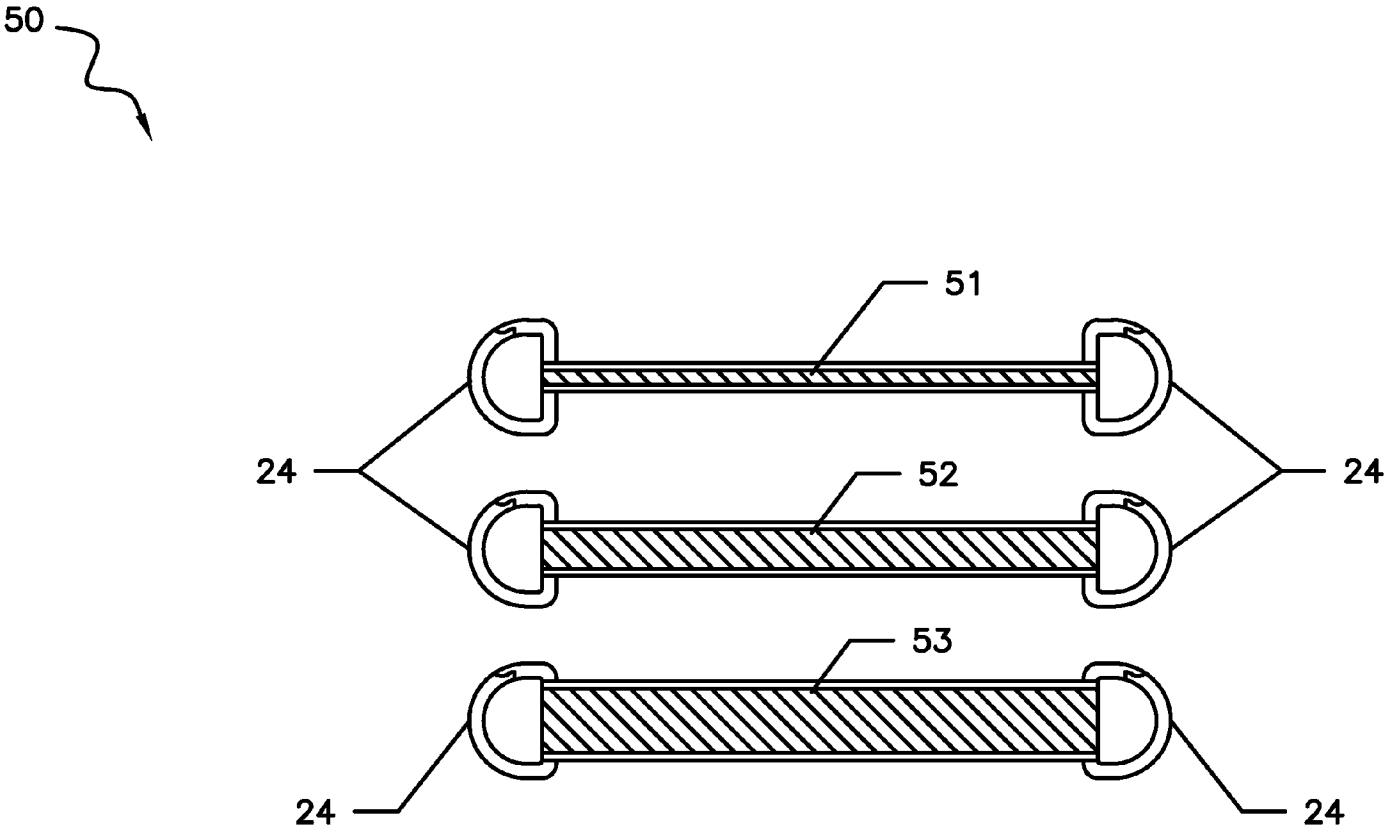
FIG. 5 is a perspective view of a plurality of watersport resistance elements of the watersport resistance training device in accordance with one embodiment of the invention.

As shown in FIG. 5, the device 10 can include a plurality of watersport resistance bands 50 that function to simulate a watersport resistance. In the preferred embodiment, the device 10 can include three elastic bands 51, 52 and 53, each having a known resistance force when stretched between a plurality of known distances. Additionally, each of the bands can also include a hook 24 disposed on both a distal and proximate end. In one exemplary embodiment, each of the resistance bands 50 can include a length (e.g., measured from the tip of the first hook to tip of the second hook) of approximately 21 inches, however, other lengths and widths are also contemplated.

In operation, one or more of the bands 51, 52 and 53 can engage the primary ring 25*a* and a secondary ring 25*b*, 25*c* or 25*d*, in order to provide an accurate representation of watersport resistance during a particular watersport activity. In this regard, each of the bands 51, 52 and 53 can include a resistance force as outlined in TABLE 2 below, when fully stretched between the primary ring 25*a*, and one of the secondary rings 25*b*, 25*c*, or 25*d*, resulting in the band being stretched 6 inches, 12 inches and 18 inches, respectively, before being limited by the inelastic strap 21.

TABLE 2

| | ring settings and resistance in pounds | | |
|---|---|---|---|
| Resistance Band | 6" pull 25a-25d | 12" pull 25a-25c | 18" pull 25a-25b |
| resistance band 51 | 15 | 20 | 30 |
| resistance band 52 | 20 | 30 | 35 |
| resistance band 53 | 30 | 45 | 55 |
| resistance bands 51 and 53 | 40 | 60 | 85 |
| resistance bands 52 and 53 | 45 | 65 | 90 |

For the sake of completeness, it should be noted that the combination of bands 51 and 52 can produce the same resistance load as band 53; therefore, this combination is not presented within the tables. In either instance, and based on the information provided in tables 1 and 2, the device can present users with a simple and easy way to establish a watersport resistance for a particular watersport activity by selecting one or more of the bands 51-53 and securing the same between two of the rings 25, as described below with respect to TABLE 3.

TABLE 3

| | ring settings and watersport activity | | |
|---|---|---|---|
| Resistance Band | 25a-25d (6" pull) | 25a-25c (12" pull) | 25a-25b (18" pull) |
| resistance band 51 | kneeboarding (calm) | kneeboarding (moderate) | kneeboarding (choppy) |
| resistance band 52 | kneeboarding (moderate) | kneeboarding (choppy) | trick skiing (calm) |
| resistance band 53 | kneeboarding (choppy) | combo skiing/ wakeboarding (calm) | combo skiing/ wakeboarding (choppy) |
| resistance bands 51 and 53 | trick skiing (calm) | slalom skiing (calm) | air chair (calm) |
| resistance bands 52 and 53 | combo skiing/ wakeboarding (calm) | slalom skiing (choppy) | air chair (choppy) |

Figure 6:
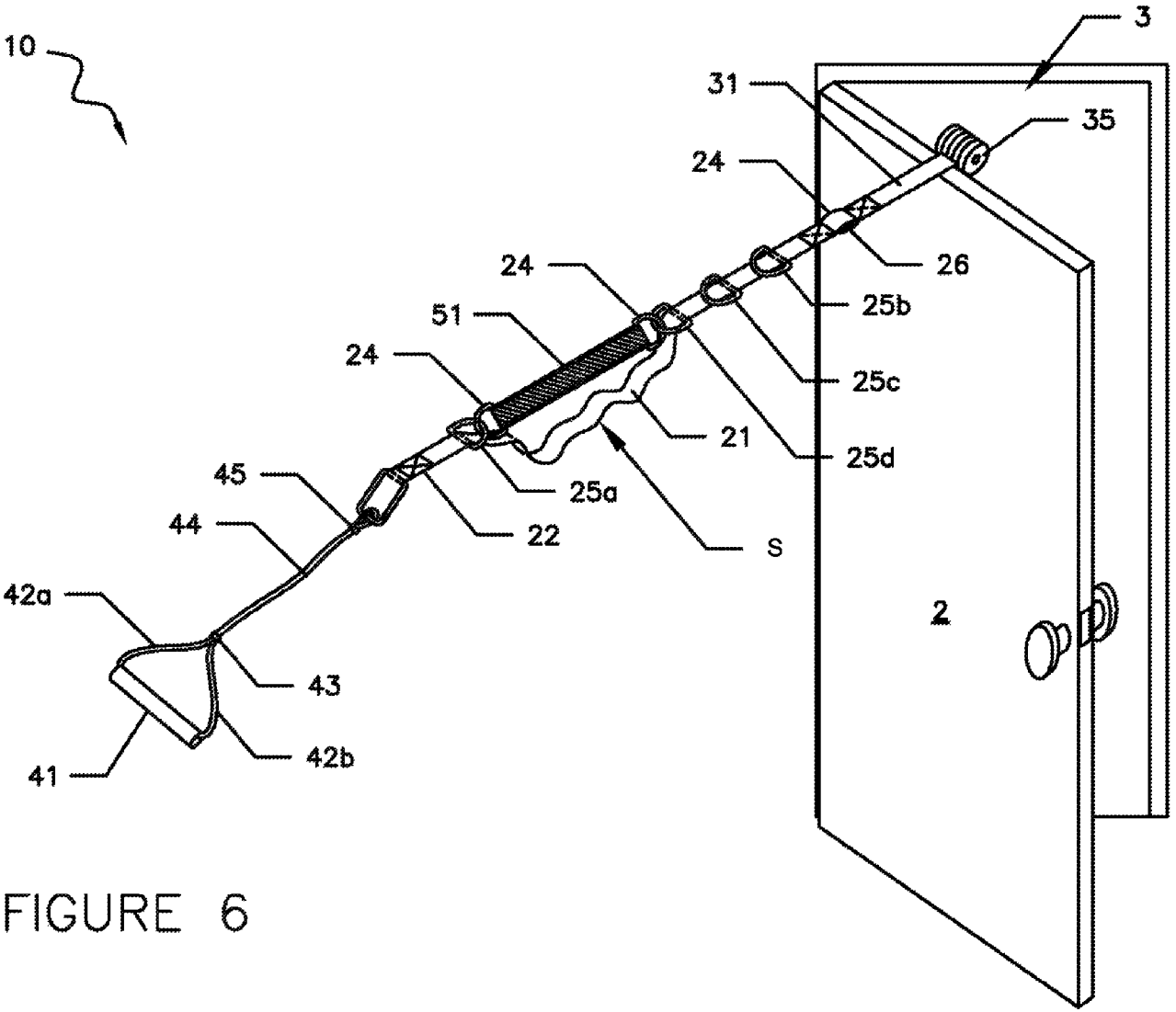
FIG. 6 is a perspective view of the assembled watersport resistance training device in accordance with one embodiment of the invention.

FIG. 6 illustrates one embodiment of the device 10 in an assembled configuration while being secured to a structure. As shown, the anchor unit 30 is connected to the top of the inelastic member 20 via the first hook 24, and the ski handle 40 is connected to the bottom of the inelastic member 20 via loops 22 and 45. Next, one or more of the resistance bands are connected to two of the rings. In the presently illustrated example, band 51 is connected between rings 25*a* and 25*d*; however, any number of other combinations is possible, as evidenced by table 3. In either instance, whenever one or more of the bands are connected to the rings, and no tension is applied thereto, the portion of the inelastic strap 21 between the selected rings will be slack S.

Figure 7:
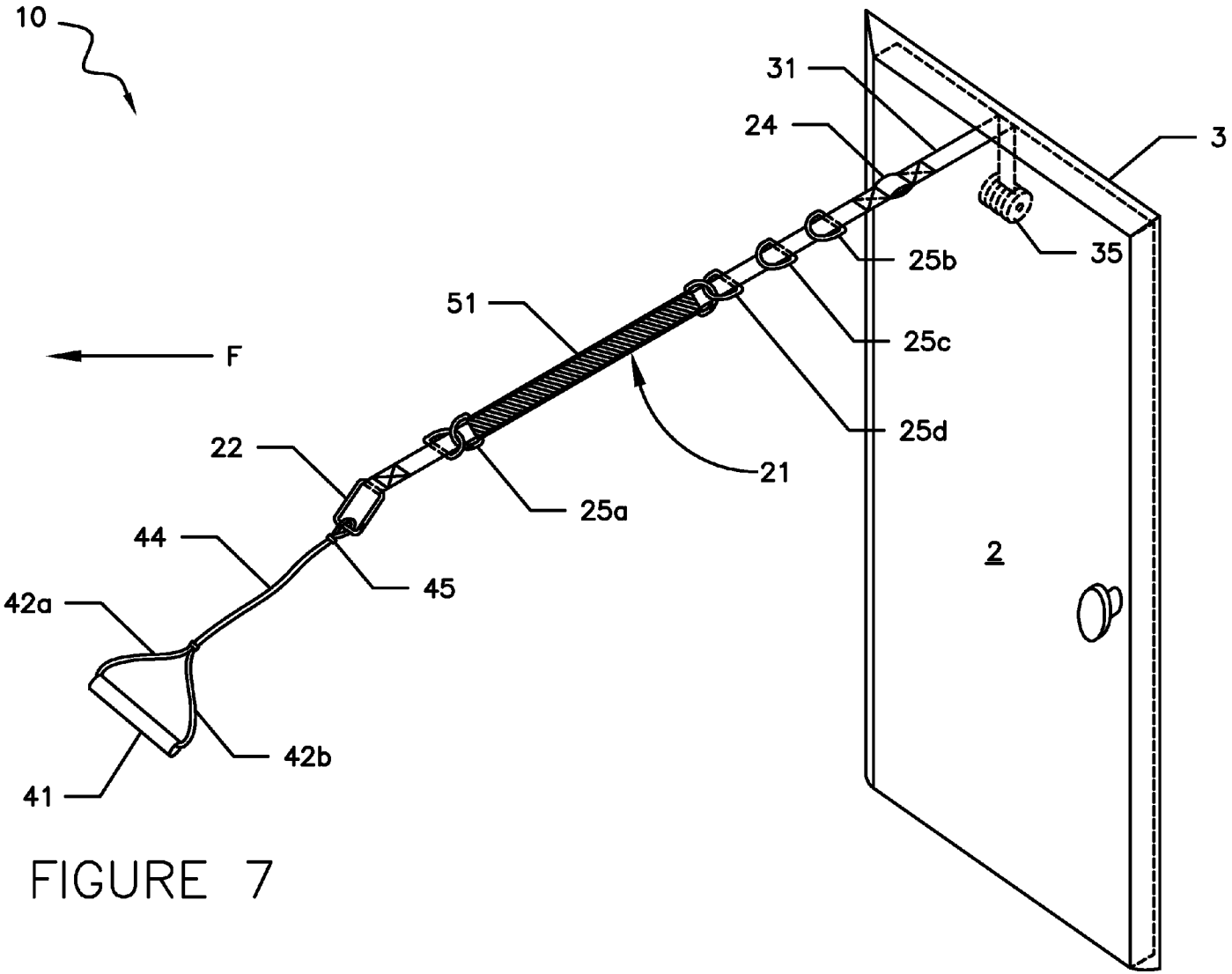
FIG. 7 is another perspective view of the assembled watersport resistance training device in accordance with one embodiment of the invention.

As shown in FIG. 7, when a user applies a pulling force F to the ski handle 40, the band 50 will expand, and the inelastic strap 21 will become taught, thereby removing the slack and preventing the band from being stretched beyond the desired tension amount. Such a feature will function to provide the user with a constant watersport resistance for a user specified watersport activity, as described above with respect to tables 1-3.

As noted above, the user can choose from a plurality of strap and/or ring selections in order to provide a watersports resistance in line with what they would experience on the water. Additionally, once the watersport resistance has been established, the device can facilitate any number of different exercise routines which can simulate performing tricks on the water, such as jumping, twisting and the like, while maintaining constant watersport resistance.

Figure 8A:
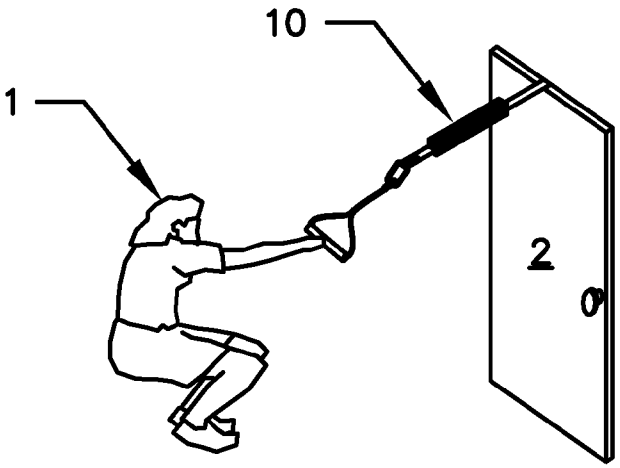
FIGS. 8A-8E illustrate poses of a user using the watersport resistance training device in accordance with one embodiment of the invention.
Figure 8B:
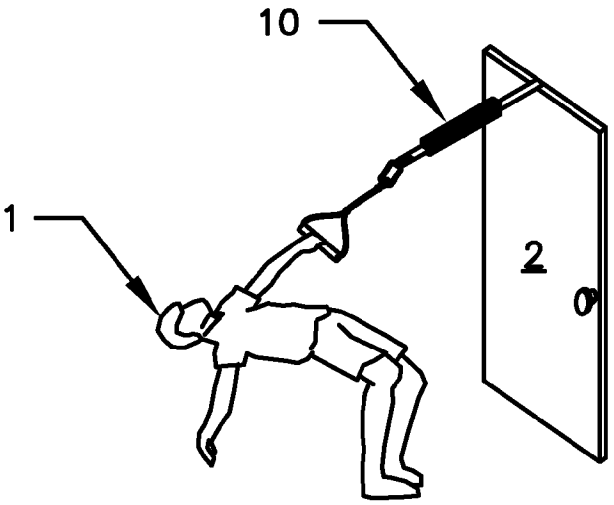
Figure 8C:
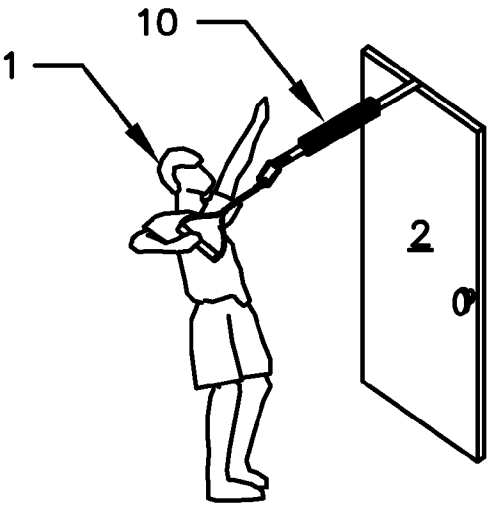
Figure 8E:
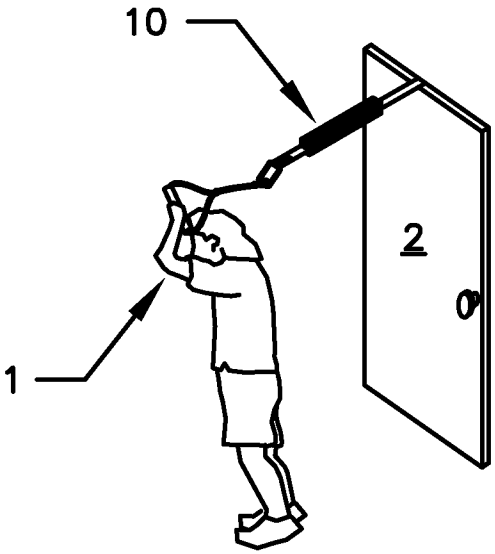
Figure 8D:
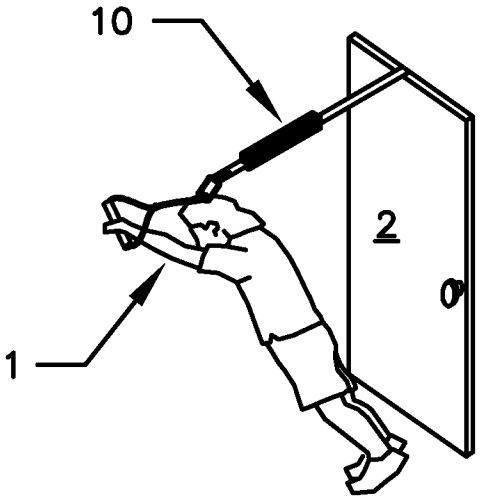

Apart from the watersport training aspects described above, the inventive watersport resistance training device also allows for a wide range of exercises. Several nonlimiting examples of the many exercises that are possible are illustrated in FIGS. 8*a*-8*e*. In each of these exercises, the device can first transition to the stretched position illustrated in FIG. 7 and remain in that position throughout the users' workout. As such, the user can perform multiple exercises while maintaining the band in a stretched position, and the strap in a taught position, thereby receiving a constant pulling force from the selected band. The illustrated exercises including a front squat (FIG. 8A), leaning back squat (FIG. 8B), reaching up squat (FIG. 8C), inclined overhead press (FIG. 8D), and the vertical overhead press (FIG. 8E). Although not illustrated, the device can further include a plurality of exercise instructions in the form of pictorial cards demonstrating exercise routines utilizing the device.

As will be apparent to those of skill in the art, many different types of exercises are possible with the inventive device, based on the selected resistance, body position and type of ski handle grip selected (e.g., two-handed or one-handed). Accordingly, the watersport resistance training device 10 described herein can function to simulate the effects of watersport resistance for utilization as a ski trainer while simultaneously providing an enhanced workout in a novel manner.

As described herein, one or more elements of the watersport resistance training device 10 can be secured together utilizing any number of known attachment means such as, for example, stitching, screws, glue, compression fittings and welds, among others. Moreover, although the above embodiments have been described as including separate individual elements, the inventive concepts disclosed herein are not so limiting. To this end, one of skill in the art will recognize that one or more individual elements of the inelastic member 20, the anchor unit 30, and/or the ski handle assembly 40, for example, may be formed together as one continuous element, either through manufacturing processes, such as welding, stitching, adhesives, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A watersport resistance training device, comprising:

an elongated inelastic strap having a top end, a bottom end and a middle section;

a plurality of rings that are disposed along a length of the strap;

an anchor unit having a first end that is removably secured to the top end of the elongated strap, and a connector that is disposed along a second end thereof;

a ski handle assembly that is in communication with the bottom end of the elongated strap; and at least one watersport resistance element that includes an elastic band having a hook disposed on a first and second end thereof, wherein the at least one watersport resistance element is configured to be removably secured to two of the plurality of rings to create a predetermined watersport resistance when the element is in a stretched position.

2. The device of claim 1, wherein the elongated inelastic strap includes a linear length of approximately 47 inches, and further includes a pair of loops formed along the top end and the bottom end.

3. The device of claim 1, wherein the plurality of rings comprises:

a primary ring that is disposed along the inelastic strap at a first distance from the bottom end of the strap;

a second ring that is disposed along the inelastic strap at a second distance measured from the top end of the strap;

a third ring that is disposed along the inelastic strap at a third distance measured from the second ring; and a fourth ring that is disposed along the inelastic strap at a fourth distance measured from the third ring, and a fifth distance from the primary ring.

4. The device of claim 3, wherein:

the first distance is approximately 4 inches;

the second distance is approximately 4 inches;

the third distance is approximately 6 inches;

the fourth distance is approximately 6 inches; and the fifth distance is approximately 27 inches.

5. The device of claim 3, wherein the at least one watersport resistance element includes a first elastic band having a first watersport resistance when stretched between the primary ring and the fourth ring, a second watersport resistance when stretched between the primary ring and the third ring, and a third watersport resistance when stretched between the primary ring and the second ring.

6. The device of claim 5, wherein:

the first watersport resistance is approximately 15 pounds and simulates kneeboarding in calm water, the second watersport resistance is approximately 20 pounds and simulates kneeboarding in moderate water, and the third watersport resistance is approximately 30 pounds and simulates kneeboarding in choppy water.

7. The device of claim 5, further comprising:

a second watersport resistance element that includes a second elastic band having a first watersport resistance when stretched between the primary ring and the fourth ring, a second watersport resistance when stretched between the primary ring and the third ring, and a third watersport resistance when stretched between the primary ring and the second ring.

8. The device of claim 7, wherein:

the first watersport resistance of the second band is approximately 20 pounds and simulates kneeboarding in moderate water, the second watersport resistance of the second band is approximately 30 pounds and simulates kneeboarding in choppy water, and the third watersport resistance of the second band is approximately 35 pounds and simulates trick skiing in calm water.

9. The device of claim 7, further comprising:

a third watersport resistance element that includes a third elastic band having a first watersport resistance when stretched between the primary ring and the fourth ring, a second watersport resistance when stretched between the primary ring and the third ring, and a third watersport resistance when stretched between the primary ring and the second ring.

10. The device of claim 9, wherein:

the first watersport resistance of the third band is approximately 30 pounds and simulates kneeboarding in choppy water, the second watersport resistance of the third band is approximately 45 pounds and simulates wakeboarding in calm water, and the third watersport resistance of the third band is approximately 55 pounds and simulates wakeboarding in choppy water.

11. The device of claim 9, wherein the first and third bands have a combined a first combined watersport resistance when stretched between the primary ring and the fourth ring, a second combined watersport resistance when stretched between the primary ring and the third ring, and a third combined watersport resistance when stretched between the primary ring and the second ring.

12. The device of claim 11, wherein the first combined watersport resistance of the first and third bands is approximately 40 pounds and simulates trick skiing in calm water, the second combined watersport resistance of the first and third band is approximately 60 pounds and simulates slalom skiing in calm water, and the third combined watersport resistance of the first and third band is approximately 85 pounds and simulates an air chair in calm water.

13. The device of claim 9, wherein the second and third bands have a first combined watersport resistance when stretched between the primary ring and the fourth ring, a second combined watersport resistance when stretched between the primary ring and the third ring, and a third combined watersport resistance when stretched between the primary ring and the second ring.

14. The device of claim 13, wherein the first combined watersport resistance of the second and third bands is approximately 45 pounds and simulates wakeboarding in calm water, the second combined watersport resistance of the second and third bands is approximately 65 pounds and simulates slalom skiing in choppy water, and the third combined watersport resistance of the second and third band is approximately 90 pounds and simulates an air chair in choppy water.

15. The device of claim 1, wherein the connector includes a ring of high density foam that is configured to be positioned between a door and a door jamb without causing damage to the same.

16. The device of claim 1, wherein the ski handle assembly comprises:

a handle that is interposed between a pair of angled arms which are connected to an elongated tether.

17. The device of claim 6, wherein the handle assembly is removably secured to the bottom end of the inelastic strap.

18. The device of claim 6, wherein the handle assembly is permanently secured to the bottom end of the inelastic strap.

19. The device of claim 1, wherein the inelastic strap further includes a loop formed in the bottom end thereof, said loop functioning to receive a different ski handle assembly.

20. The device of claim 1, further comprising:

a plurality of instructional cards pictorially illustrating exercise routines utilizing the device.

* * * * *